US007281651B1

(12) United States Patent
Heald et al.

(10) Patent No.: US 7,281,651 B1
(45) Date of Patent: Oct. 16, 2007

(54) MULTIPLE MAILBOX MOUNT

(75) Inventors: Darrell W. Heald, Round Rock, TX (US); Ronald D. Riker, Brownwood, TX (US); Charles G. Champ, Round Rock, TX (US)

(73) Assignee: Caminoverde II, L.L.P., Hurro, TX (US)

( * ) Notice: Subject to any disclaimer, the term of this patent is extended or adjusted under 35 U.S.C. 154(b) by 0 days.

(21) Appl. No.: 11/309,161

(22) Filed: Jul. 3, 2006

(51) Int. Cl.
*A47G 29/12* (2006.01)

(52) U.S. Cl. ..... 232/39; 248/146; 248/545; 248/548

(58) Field of Classification Search ..... 232/39; D99/32; 248/159, 548, 545, 146, 156
See application file for complete search history.

(56) References Cited

U.S. PATENT DOCUMENTS

| | | | | |
|---|---|---|---|---|
| 0,019,578 | A | 3/1858 | Potts | |
| 1,350,770 | A | 3/1920 | Bates et al. | |
| 1,553,785 | A * | 9/1925 | Ley | 52/297 |
| D92,913 | S * | 7/1934 | Mahoney | D99/32 |
| 1,994,186 | A | 3/1935 | Anderson | |
| 2,114,058 | A * | 4/1938 | Mahoney | 52/40 |
| 2,746,208 | A | 5/1956 | Lewis | |
| D200,748 | S * | 3/1965 | Taylor | D99/32 |
| 3,497,078 | A | 2/1970 | Nash | |
| D230,774 | S * | 3/1974 | Stevenson | D99/32 |
| 4,187,978 | A * | 2/1980 | Dowker | 232/39 |
| 4,286,747 | A | 9/1981 | Deike | |
| 4,484,705 | A | 11/1984 | Sande | |
| 4,793,110 | A * | 12/1988 | Tucker | 52/297 |
| 4,915,293 | A | 4/1990 | Paramski | |
| 4,955,533 | A | 9/1990 | Merkel | |
| 5,020,720 | A | 6/1991 | Harpe | |
| 5,411,206 | A | 5/1995 | Latham et al. | |
| 5,445,086 | A | 8/1995 | Bolduc | |
| 5,524,858 | A | 6/1996 | Friend | |
| 5,713,514 | A | 2/1998 | Eck | |
| 6,223,982 | B1 | 5/2001 | Dunn | |
| 7,003,919 | B2 | 2/2006 | Riker | |
| 2005/0127259 | A1 | 6/2005 | Riker | |

* cited by examiner

*Primary Examiner*—William L. Miller
(74) *Attorney, Agent, or Firm*—Daniel V. Thompson

(57) ABSTRACT

A multiple mailbox mount has a vertical post adapted to be anchored in the ground. A body having two opposed, spaced-apart, vertical ends, a continuously-semicircular curved section extending between the vertical ends, and a midpoint, is attached to the vertical post at the midpoint. A horizontal bar extends between the vertical ends of the body.

14 Claims, 3 Drawing Sheets

MULTIPLE MAILBOX MOUNT

BACKGROUND OF THE INVENTION

1. Field of the Invention

This invention relates to mounting apparatus for mailboxes, and in particular to a multiple mailbox mount having improved safety characteristics when accidentally struck by vehicles.

2. Description of Prior Art

On rural highways mailboxes are often placed close to the edge of the pavement, where the mail carrier and homeowner can reach them from inside a vehicle. Multiple mailboxes are often mounted on a common mount, for convenience and efficiency.

A mailbox mounted near a highway is considered a hazard and is required by law to be designed to do as little damage as possible to a vehicle that hits it. The mounting post must be a break-away design with a base that will not cause a small vehicle to roll over. The top of the mount must be designed so it won't separate from the post and become a missile that could penetrate the windshield of a vehicle during an accident.

Multiple mailbox mounts in the past have usually included at least one vertical post and a horizontal member at the desired level for access to the mailboxes. High-mass materials such as wood or metal are frequently used in such relatively primitive structures. In the event of a vehicle collision with the structure, the horizontal member can be freed from one or more of the vertical posts with inertia sufficient to permit it to intrude into the interior of the vehicle, with obvious hazard to the driver and passengers. There is thus a need for a low-mass multiple mailbox mount that preserves the integrity of the horizontal member to vertical post attachments, with a yieldable vertical post to ground connection, such that the integral structure is impacted away from or under the vehicle and intrusion into the vehicle is made less likely. Ready reconnection of the vertical post to ground connection after impact is also desirable.

One such yieldable, readily-reconnectable, post to ground connection is disclosed in U.S. Pat. No. 7,003,919, entitled "Post Mount Assembly," issued Feb. 28, 2006, to Ronald D. Riker and assigned to the assignee of the present invention, the disclosure of which is incorporated herein by reference as if fully set forth. A superior mailbox to mount connection is disclosed in U.S. Pat. No. 7,178,772, entitled "Mailbox Post Bracket," issued Feb. 20, 2007 to Ronald D. Riker and assigned to the assignee of the present invention, the disclosure of which is incorporated herein by reference as if fully set forth.

SUMMARY OF THE INVENTION

The present invention provides a solution to the problem just described by mounting mailboxes on an integral, low-mass structure with a semicircular body adapted to maintain its integrity in the event of a collision and reduce the likelihood of vehicle intrusion.

BRIEF DESCRIPTION OF THE DRAWINGS

A more complete understanding of the invention and its advantages will be apparent from a review of the Detailed Description in conjunction with the following Drawings, in which.

DETAILED DESCRIPTION

Figure 1:
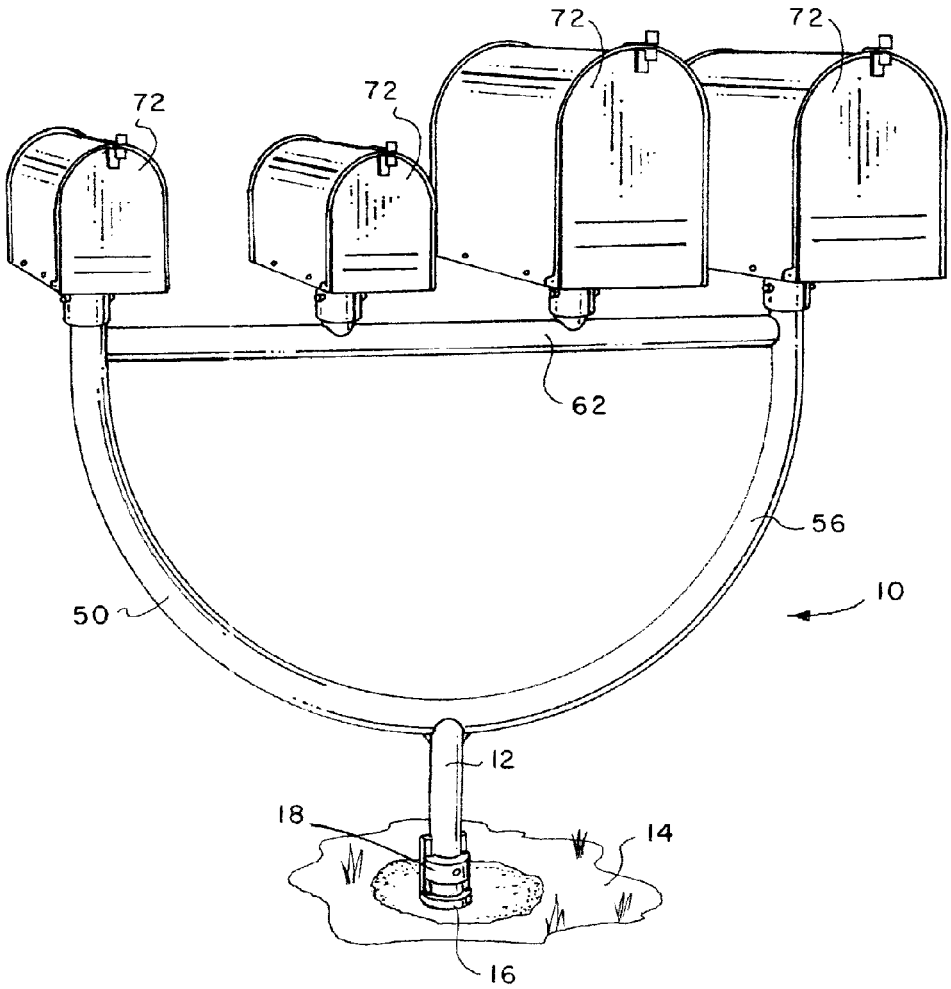
FIG. 1 is a perspective view of a multiple mailbox mount constructed in accordance with the invention and mounted alongside a highway.
Figure 2:
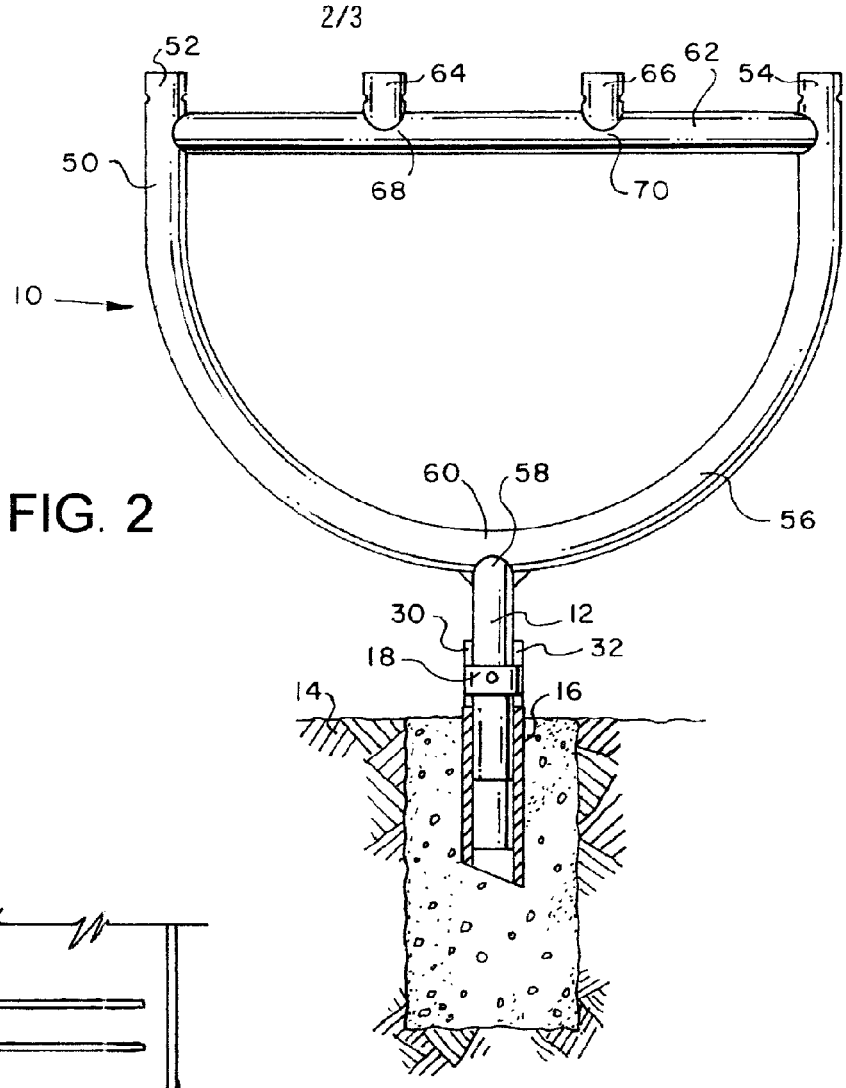
FIG. 2 is a partially broken-away, front elevation view of the mount of FIG. 1, without the mailboxes.
Figure 3:
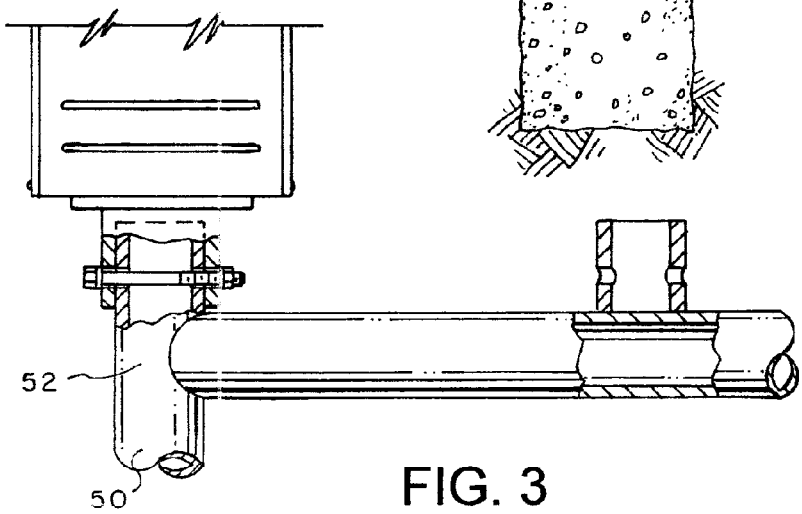
FIG. 3 is a partially broken-away, detail view of the an upper portion of the mount of FIG. 1.
Figure 4:
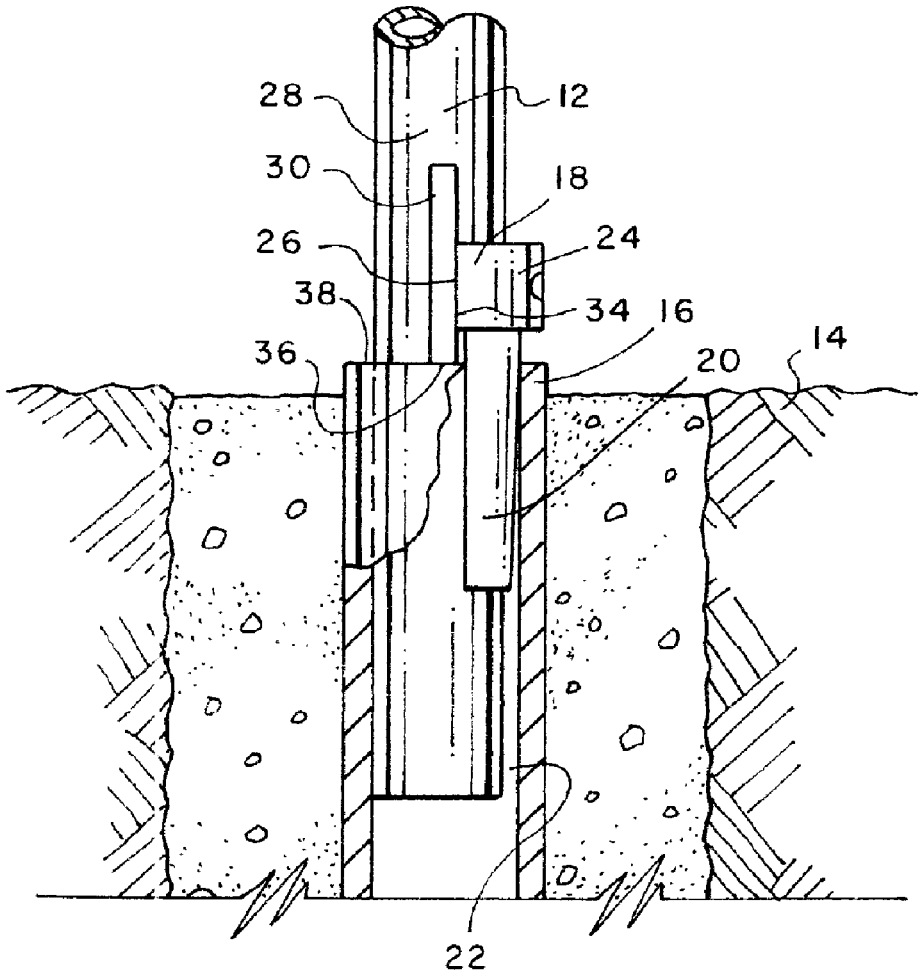
FIG. 4 is a partially broken-away, detail view of the lower portion of the mount of FIG. 1.

Referring initially to FIGS. 1-4, where like numerals indicate like and corresponding elements, a multiple mailbox mount 10 has a vertical post 12 adapted to be anchored in the ground 14 in a socket 16. In accordance with U.S. Pat. No. 7,003,919, a wedge member 18 has a tapered portion 20 (FIG. 4) filling a gap 22 between the socket 16 and the post 12.

The wedge member 18 has a top 24 with vertical end walls 26. At least the lower portion of the vertical post 12 is tubular, with a smooth exterior surface 28, and with two diametrically-opposed tabs 30,32 extending from the exterior surface 28. The tabs 30,32 have planar, vertical faces 34 arranged and adapted to engage the vertical end walls 26 of the wedge member top 24 to prevent turning of the post 12 in the socket 16.

The tabs 30,32 also have planar, horizontal, bottom faces 36 arranged and adapted to engage a top surface 38 of the socket 16 to establish an insertion depth of the post 12 in the socket 16.

Mount 10 includes a body 50 having two opposed, spaced-apart, vertical ends 52,54. A continuously-semicircular curved section 56 extends between the vertical ends 52,54. The body 50 is attached to a top 58 of the vertical post 12 at a midpoint 60.

A horizontal bar 62 extends between the vertical ends 52,54 of the body 50. The horizontal bar 62 has two tubular, vertical, medial mounts 64,66 extending upwardly from the bar 62 from medial locations 68,70 on the bar 62, the medial mounts 64,66 being each adapted to support a mailbox 72, and with the medial mounts 64,66 being sized similarly to the vertical ends 52,54 of the body 50 to interchangeably mount mailboxes 72 with the vertical ends 52,54 of the body. Interchangeable connection of mailboxes 72 to vertical ends 52,54 and medial mounts 64,66 is best enabled by the bracket disclosed in U.S. Pat. No. 7,178,772, entitled "Mailbox Post Bracket," issued Feb. 20, 2007 to Ronald D. Riker.

A key feature of the invention is that the vertical post 12, body 50 and horizontal bar 64 are an integrally-formed structure of permanently-connected tubular sections. One example of the integrally-formed structure of vertical post 12, body 50 and horizontal bar 62 is formed of welded, galvanized metal pipe having an outer diameter of about 2.38 inches and a wall thickness of about 0.065 inches.

In operation, enhanced crashworthiness is provided by the smoothly and continuously curved body 50, in combination with the socket and wedge connection at the ground, which permits the mailboxes, brackets and mount to stay intact, with the post pulling out of the socket, upon vehicle impact.

It will be understood that each of the elements described above, or two or more together, may also find a useful application in other types of constructions differing from the type described above.

While the invention has been illustrated and described as embodied in a particular multiple mailbox mount, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Whereas, the present invention has been described with respect to a specific embodiment thereof, it will be understood that various changes and modifications will be suggested to one skilled in the art and it is intended to encompass such changes and modifications as fall within the scope of the appended claims or claims added by amendment during the prosecution hereof.

What is claimed is:

1. A multiple mailbox mount, comprising:

a vertical post adapted to be anchored in the ground;

a body having two opposed, spaced-apart, vertical ends, a continuously-semicircular curved section extending between the vertical ends, and a midpoint, the body being attached to the vertical post at the midpoint;

a horizontal bar extending between the vertical ends of the body, at least one of the body and the horizontal bar adapted to support at least one mailbox thereon;

with the vertical post adapted to be anchored in the ground in a socket;

with a wedge member having a tapered portion filling a gap between the socket and the post;

the wedge member having a top with vertical end walls;

the vertical post being tubular with a smooth exterior surface and having two diametrically-opposed tabs extending from the exterior surface; and the tabs having planar, vertical faces arranged and adapted to engage the vertical end walls of the wedge member top to prevent turning of the post in the socket.

2. The mount of claim 1 with the vertical ends of the body being each adapted to support a mailbox.

3. The mount of claim 2 with the horizontal bar having two tubular, vertical, medial mounts extending upwardly from the bar from medial locations on the bar, the medial mounts being each adapted to support a mailbox.

4. A multiple mailbox mount, comprising:

a vertical post adapted to be anchored in the ground;

a body having two opposed, spaced-apart, vertical ends, a continuously-semicircular curved section extending between the vertical ends, and a midpoint, the body being attached to the vertical post at the midpoint;

a horizontal bar extending between the vertical ends of the body, at least one of the body and the horizontal bar adapted to support at least one mailbox thereon;

with the vertical post, body and horizontal bar being an integrally-formed structure of permanently-connected tubular sections.

5. The mount of claim 4 with the vertical post adapted to be anchored in the ground in a socket.

6. The mount of claim 5 with a wedge member having a tapered portion filling a gap between the socket and the post.

7. The mount of claim 6 with:

the wedge member having a top with vertical end walls;

the vertical post being tubular with a smooth exterior surface and having two diametrically-opposed tabs extending from the exterior surface; and the tabs having planar, vertical faces arranged and adapted to engage the vertical end walls of the wedge member top to prevent turning of the post in the socket.

8. The mount of claim 7 with the vertical ends of the body being each adapted to support a mailbox.

9. The mount of claim 8 with the horizontal bar having two tubular, vertical, medial mounts extending upwardly from the bar from medial locations on the bar, the medial mounts being each adapted to support a mailbox.

10. The mount of claim 9 with the medial mounts being sized similarly to the vertical ends of the body to interchangeably mount mailboxes with the vertical ends of the body.

11. The mount of claim 4 with the vertical ends of the body being each adapted to support a mailbox.

12. The mount of claim 11 with the horizontal bar having two tubular, vertical, medial mounts extending upwardly from the bar from medial locations on the bar, the medial mounts being each adapted to support a mailbox.

13. The mount of claim 4 with the vertical post, body and horizontal bar being formed of galvanized metal pipe having an outer diameter of about 2.38 inches and a wall thickness of about 0.065 inches.

14. A multiple mailbox mount, comprising:

a vertical post adapted to be anchored in the ground in a socket;

with a wedge member having a tapered portion filling a gap between the socket and the post, and with the wedge member having a top with vertical end walls;

the vertical post being tubular with a smooth exterior surface and having two diametrically-opposed tabs extending from the exterior surface;

the tabs having planar, vertical faces arranged and adapted to engage the vertical end walls of the wedge member top to prevent turning of the post in the socket;

the tabs having planar, horizontal, bottom faces arranged and adapted to engage a top surface of the socket to establish an insertion depth of the post in the socket;

a body having two opposed, spaced-apart, vertical ends, a continuously-semicircular curved section extending between the vertical ends, and a midpoint, the body being attached to a top of the vertical post at the midpoint;

the vertical ends of the body being each adapted to support a mailbox;

a horizontal bar extending between the vertical ends of the body;

with the vertical post, body and horizontal bar being an integrally-formed structure of permanently-connected tubular sections;

with the vertical post, body and horizontal bar being formed of galvanized metal pipe having an outer diameter of about 2.38 inches and a wall thickness of about 0.065 inches; and the horizontal bar having two tubular, vertical, medial mounts extending upwardly from the bar from medial locations on the bar, the medial mounts being each adapted to support a mailbox, and with the medial mounts being sized similarly to the vertical ends of the body to interchangeably mount mailboxes with the vertical ends of the body.

* * * * *